US012172214B2

(12) United States Patent
Buresh et al.

(10) Patent No.: US 12,172,214 B2
(45) Date of Patent: Dec. 24, 2024

(54) HOT ISOSTATIC PRESSING CONTAINER WITH ENHANCED DIRECTIONAL CONSOLIDATION

(71) Applicant: General Electric Company, Schenectady, NY (US)

(72) Inventors: Steve J. Buresh, Niskayuna, NY (US); Shenyan Huang, Niskayuna, NY (US)

(73) Assignee: GE Infrastructure Technology LLC, Greenville, SC (US)

( * ) Notice: Subject to any disclaimer, the term of this patent is extended or adjusted under 35 U.S.C. 154(b) by 33 days.

(21) Appl. No.: 17/935,208

(22) Filed: Sep. 26, 2022

(65) Prior Publication Data

US 2024/0100595 A1 Mar. 28, 2024

(51) Int. Cl.

| | |
|---|---|
| ***B22F 3/15*** | (2006.01) |
| ***B22F 1/054*** | (2022.01) |
| ***B22F 3/12*** | (2006.01) |

(52) U.S. Cl.

CPC ..... *B22F 3/15* (2013.01); *B22F 1/054* (2022.01); *B22F 3/1208* (2013.01); *B22F 2003/153* (2013.01); *B22F 2301/35* (2013.01)

(58) Field of Classification Search

CPC ..... B22F 3/15; B22F 1/054; B22F 3/1208; B22F 2003/153; B22F 2301/35

See application file for complete search history.

(56) References Cited

U.S. PATENT DOCUMENTS

| | | | | |
|---|---|---|---|---|
| 4,409,029 | A | 10/1983 | Larker et al. | |
| 4,642,204 | A | 2/1987 | Burstrom et al. | |
| 8,303,289 | B2 | 11/2012 | Goller et al. | |
| 8,376,726 | B2 | 2/2013 | Goller et al. | |
| 11,361,872 | B2 | 6/2022 | Moricca | |
| 2011/0027120 | A1* | 2/2011 | Goller | B22F 3/1208 419/49 |
| 2011/0052444 | A1 | 3/2011 | Goller et al. | |
| 2016/0243621 | A1* | 8/2016 | Lucas | B22F 10/64 |

FOREIGN PATENT DOCUMENTS

| | | | |
|---|---|---|---|
| JP | H0580197 | A | 4/1993 |
| JP | H0914855 | A * | 1/1997 |
| JP | H09143855 | A | 6/1997 |
| WO | 90/03648 | A1 | 4/1990 |

* cited by examiner

*Primary Examiner* — Rebecca Janssen

(74) *Attorney, Agent, or Firm* — Eversheds Sutherland (US) LLP

(57) ABSTRACT

The present application provides a container for use in manufacturing a metal billet from a metal powder in a hot isostatic pressing process. The container may include a top, a bottom, a wall extending between the top and the bottom, an enhanced directional consolidation feature in the wall, and a sleeve positioned about the enhanced directional consolidation feature.

19 Claims, 2 Drawing Sheets

HOT ISOSTATIC PRESSING CONTAINER WITH ENHANCED DIRECTIONAL CONSOLIDATION

GOVERNMENT LICENSE RIGHTS

This invention was made with U.S. Government support under Contract Number DE-FE0031907 awarded by the United States Department of Energy. The Government has certain rights in the invention.

TECHNICAL FIELD

The present application and the resultant patent relate generally to improved containers and methods for forming billets from metal powder using hot isostatic pressing and more specifically relate to containers and methods having features that control the deformation of the containers during the high temperatures and pressures experienced in such hot isostatic pressing so as to reduce the overall material waste therein.

BACKGROUND OF THE INVENTION

Metallurgical techniques have been developed for the manufacture of a metal billet or other type of objects from metal powders created in a predetermined particle size by, e.g., microcasting or atomization. These powders usually are highly alloyed with Ni, Cr, Co, Fe, and the like and may be consolidated into a dense mass approaching one hundred percent theoretical density. The resulting billets generally have a uniform composition and a dense microstructure providing for the manufacture of components having good toughness, strength, fracture resistance, and thermal expansion coefficients. Such improved properties may be particularly valuable in the fabrication of, e.g., rotary components for a turbine where high temperatures and/or high stress conditions generally exist.

The consolidation of these metal powders into a dense mass typically occurs under high pressures and temperatures in a process referred to as hot isostatic pressing ("HIP"). Typically, the powders are placed into a container that has been sealed and its contents placed under a vacuum. The container is subjected to elevated temperatures and pressurized on the outside using an inert gas such as, e.g., argon, to avoid a chemical reaction. For example, temperatures as high as about 480° C. to 1315° C. and pressures from about 51 MPa to 310 MPa or even higher may be applied to consolidate the metal powder. By pressurizing the container that is enclosing the powder, the selected fluid medium (e.g., an inert gas) applies pressure to the powder at all sides and in all directions.

Once formed, portions of the billet may be machined depending upon the nature of the deformations that occurred during the hot isostatic pressing process and the desired final shape. Given that the powder used to manufacture the billet requires high cleanliness (i.e., gas atomization of powder production) and is typically very expensive, removal of extensive portions of the billet is undesirable. Moreover, mechanically alloyed powders that are not spherical may not pack well and may have significant shrinkage during consolidation. A process that allows for shape control during compaction while limiting the later removal of material from the billet thus may be desired.

FIGS. 1 and 2 provide an exemplary illustration of the problems that may be confronted when using conventional containers in the hot isostatic pressing process. FIG. 1 provides a schematic illustration of a portion of a container 10 before being subjected to the extreme temperatures and pressures of the hot isostatic pressing process. The container 10 may be manufactured from low carbon steel, authentic stainless steel such as 304SS, and the like. The container 10 encloses a powder mixture 15 intended for compaction and provides a seal to prevent the ingress of the fluid used for pressurization, e.g., argon gas, during the hot isostatic pressing process. As is shown, one or more walls 20 of the container 10 extend between a top 25 and a bottom 30. Before pressurization, the walls 20, the top 25, and the bottom 30 of the container 10 are basically straight and/or without deformation.

FIG. 2 illustrates the same portion of the container 10 after being subject to the hot isostatic pressing process. The conditions of the hot isostatic pressing process have now converted the powder 15 into a metal billet 35. However, the change in density from a powder to a solid metal also has resulted in a rather dramatic change in volume. As the volume decreased, the container 10 also deformed with the change from the powder 15 to the billet 35. Such volume shrinkage is not uniform. The middle section of the container 10 usually shrinks more than the top and bottom regions where the existence of the top and bottom constrains the can deformation during hot isostatic pressing. FIG. 2 illustrates that the wall 20 has now taken on an arcuate or an hourglass shape. The top 25 and the bottom 30 of the container 10 may undergo deformations as well.

Depending upon the desired shape for billet 35 (or the shape of the ultimate component to be constructed from billet 35), the deformations shown in FIG. 2 may be undesirable because the resulting shape of the billet 35 may require the removal of valuable material from its surface. For example, assuming a cylindrical outer surface is needed along the wall 20 of the billet 35, the container 10 and the billet 35 may need to be machined along, e.g., a line 40 in order to obtain the desired outer surface. However, in addition to the destruction of the container 10, significant amounts of the billet 35 may be lost at portions outside of the line 40 and along the top 25 and the bottom 30 of container 10. Because of the substantial costs of the original powder, this loss is undesirable.

In another scenario, an annular cylindrical hot isostatic pressing billet is a desired shape as input stock for a subsequent tube extrusion process, because the annular shape eliminates the machining to hollow the center of a solid cylindrical billet and reduces powder waste. However, the hourglassing may occur at both the outer diameter and the inner diameter. Additionally, a tall annular billet may be subject to buckling or other non-axial deformation during hot isostatic pressing, which lacks centricity and makes it difficult to extrude into a tube.

SUMMARY OF THE INVENTION

The present application and the resultant patent provide a container for use in manufacturing a metal billet from a metal powder in a hot isostatic pressing process. The container may include a top, a bottom, a wall extending between the top and the bottom, an enhanced directional consolidation feature in the wall, and a sleeve positioned about the enhanced directional consolidation feature.

The present invention and the resultant patent further provide a method of manufacturing a metal billet from a nanostructured ferritic alloy powder in a hot isostatic pressing process. The method may include the steps of providing an enhanced directional consolidation feature in a wall of a container, filling the container with the nanostructured ferritic alloy power, subjecting the container to the hot isostatic pressing process to form the metal billet, deforming the container along the enhanced directional consolidation feature, and removing the metal billet from the container.

The present application and the resultant patent further provide a container for use in manufacturing a metal billet from a metal powder in a hot isostatic pressing process. The container may include a top, a bottom, a wall extending between the top and the bottom, a bellows in the wall, and one or sleeves positioned about the bellows.

DETAILED DESCRIPTION

Figure 1:
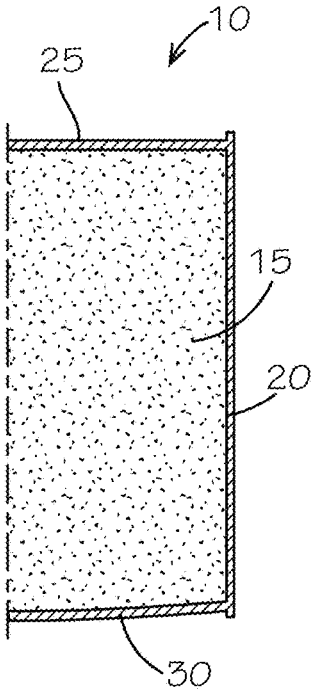
FIG. 1 (PRIOR ART)
FIG. 1 is a schematic cross-section of a container before undergoing a hot isostatic pressing process.
Figure 2:
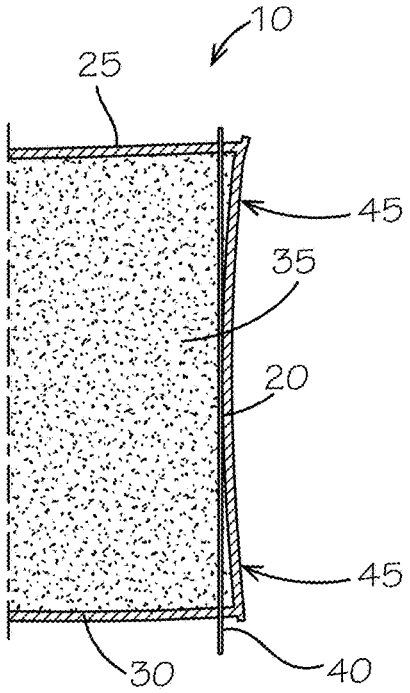
FIG. 2 (PRIOR ART)
FIG. 2 is a schematic cross-section of the container of FIG. 1 after undergoing the hot isostatic pressing process.
Figure 3:
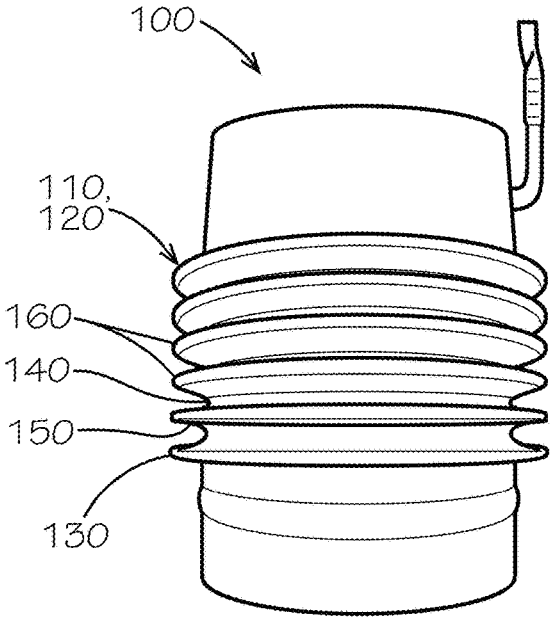
FIG. 3 is a plan view of a container with an enhanced directional consolidation feature as may be described herein before undergoing the hot isostatic pressing process.
Figure 4:
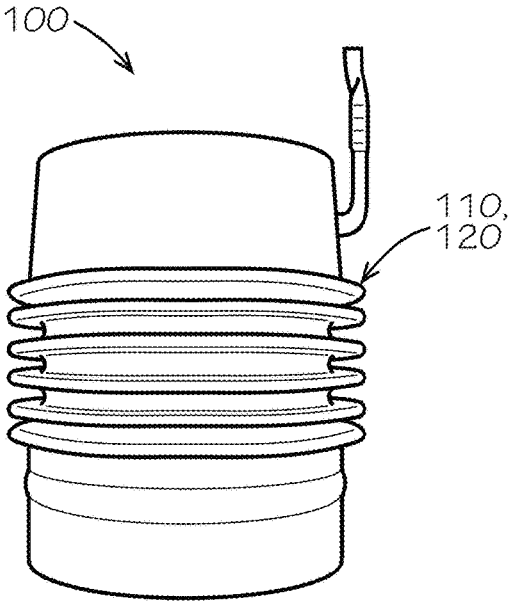
FIG. 4 is a plan view of the container with the enhanced directional consolidation feature of FIG. 3 after undergoing the hot isostatic pressing process.

Referring again to the drawings, in which like numerals refer to like elements throughout the several views, FIGS. 3 and 4 show plan views of an exemplary container 100 as may be described therein. In a manner similar to FIGS. 1 and 2, the container 100 includes one or more walls 20 extending between the top 25 and the bottom 30. The container 100 also may be filled with the powder mixture 15. As described above, the container 100 may be manufactured from low carbon steel, authentic stainless steel such as 304SS, and the like. Other types of materials may be used herein. The container 100 may have any suitable size, shape, and configuration. Likewise, many different types of powders and mixtures thereof may be used herein.

The container 100 may include an enhanced directional consolidation feature 110 formed therein. The enhanced directional consolidation feature 110 may allow the container 100 to deform in a preferential manner and direction. The enhanced directional consolidation feature 110 generally may be any structure that allows for such substantially axial deformation and shrinkage. In this example, the enhanced directional consolidation feature 110 may be in the form of a bellows 120 provided in the wall or walls 20 of the container 10. As is known, a bellows 120 may include any number of alternating crest portions 130 and root portions 140 separated by flank portions 150 in a generally sinusoidal manner. The distance between respective crest portions 130 may be described as a pitch 160. The alternating crest portions 130 and root portions 140 allow the bellows 120 to mechanically expand and/or contract. The bellows 120 may have any suitable size, shape, or configuration. The bellows 120 may be manufactured out of the same or different materials as the container 100. The bellows 120 may be formed in the walls 20 of the container 100 or the bellows 120 may be a separate structure that is attached thereto. The bellows 120 is one example of shaped features that are generally weak structures with preferential deformation in one direction, i.e., substantially axial deformation and shrinkage. The container 100 may include a feature for evacuation and/or sealing of various designs.

FIG. 3 shows the container 100 before undergoing the hot isostatic pressing process while FIG. 4 shows the container 100 after undergoing the hot isostatic pressing process. As compared to the container 10 of FIGS. 1 and 2, the reduction in the outer diameter of the containers 10, 100 may be similar but the reduction in height for the container 100 of FIGS. 3 and 4 may be almost double that of the container 10 of FIGS. 1 and 2. By providing more shrinkage along the length of the container 100 with a substantially uniform diameter, overall material waste after machining the container 100 may be significantly reduced.

Figure 5:
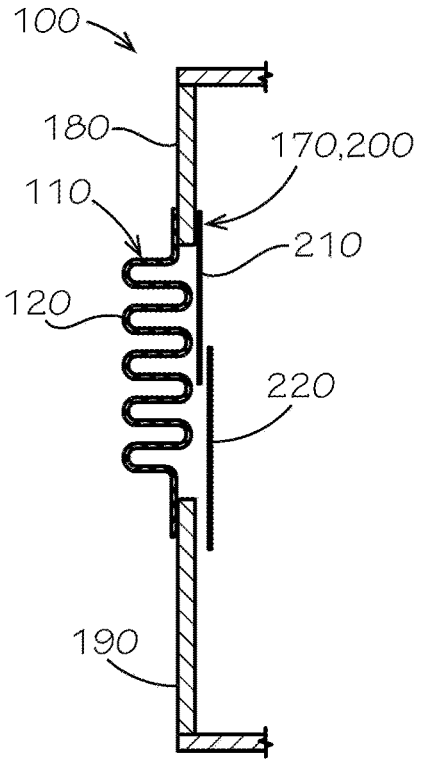
FIG. 5 is schematic cross-section of an alternative embodiment of a portion of a container with an enhanced directional consolidation feature.
Figure 6:
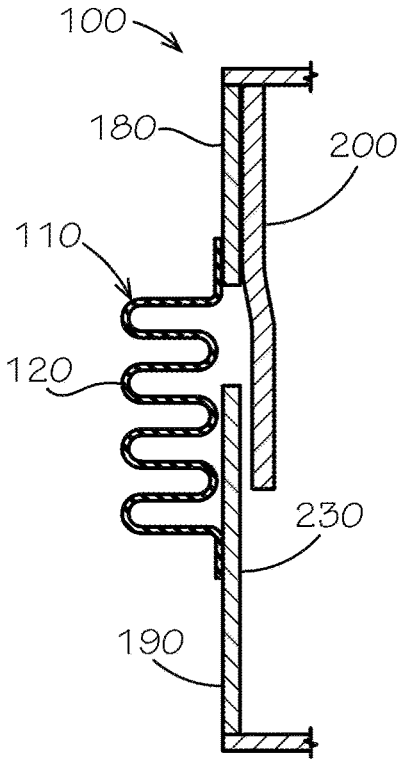
FIG. 6 is schematic cross-section of an alternative embodiment of a portion of a container with an enhanced directional consolidation feature.
Figure 7:
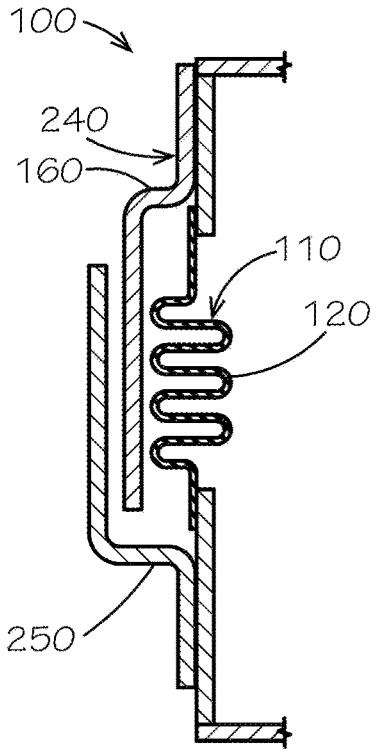
FIG. 7 is schematic cross-section of an alternative embodiment of a portion of container with an enhanced directional consolidation feature.

FIGS. 5-7 show several alternative embodiments of the container 100. In these embodiments, the enhanced directional consolidation feature 110 may include the bellows 120 and one or more sleeves 170. The sleeves 170 may be manufactured out of the same or similar materials as the container 100 and the bellows 120. For example, FIG. 5 shows the container 100 with the bellows 120 attached to the outer wall 20. Specifically, the bellow 120 may be attached via welding or other types of joining means to an upper portion 180 and a lower portion 190 of the wall 20. The enhanced directional consolidation feature 110 also may include a number of internal sleeves 200. Specifically, an upper internal sleeve 210 and a lower internal sleeve 220 may be positioned inside the container 100 in an overlapping fashion adjacent to the bellows 120. Upon deformation and shrinkage, the internal sleeves 210, 220 overlap for straightening or to prevent non-axial deformation, i.e., buckling. The sleeves 210, 220 also may prevent the powder mixture 15 from flowing into the crest portions 130 of the bellows 120 so as to reduce further the need for any subsequent machining and, hence, overall reduced material waste in the final billet 35. A metallic mesh and the like also may be used. Other components and other configurations may be used herein.

FIG. 6 shows a further embodiment of the container 100 with an internal sleeve 200. Here, the bellows 120 may be attached to the upper portion 180 of the wall 20 but to a middle portion 230 of the lower portion 190 of the wall 20. A single internal sleeve 200 may be positioned inside the container 100 about the bellows 120. In this case, the internal sleeve 200 overlaps with the lower wall portion 190 for straightening or to prevent non-axial deformation, i.e., buckling. The internal sleeve 200 and the middle portion 230 may be thick and rigid or made in a strong material at the HIP temperature to resist any non-axial deformation. Other components and other configurations may be used herein.

FIG. 7 shows a further embodiment of the container 100, in this case with an external sleeve 240. Specifically, an overlapping upper external sleeve 250 and a lower external sleeve 260 may be positioned outside the container 100 about the bellows 120. The use of the external sleeves 240 may provide for a more uniform deformation and shrinkage of the bellows 120 by reducing any outward expansion of the bellows 120 and/or the wall or walls 20 along the length of the container 100 as a whole. The external sleeve 240 may be a standard feature of the hot isostatic pressing process. The external sleeve 240 thus may be a reusable component. Specifically, the external sleeve 240 may be a removable/ separate structure (fixturing). One or more internal sleeves 200 also may be used with the external sleeves 240. Other components and other configurations may be used herein.

The container 100 with the enhanced directional consolidation feature 110 thus uses a structural feature such as the bellows 120 to provide significant deformation in a preferential direction during hot iso static pressing processing. Specifically, the structural features of the bellows 120 and the like are designed to deform in a particular fashion/direction. The flexible nature of the bellows 120 allows deformation at lower stresses. The bellows 120 thus allow the container 100 to collapse more easily in the axial direction versus the radial direction. Such a controlled deformation should reduce powder waste, save cost, and add overall shape control. Moreover, a container 100 with this enhanced directional consolidation feature 110 could be hot or cold pre-compressed axially before hot isostatic pressing to improve further starting density uniformity and final shape. Other applications may allow the use of otherwise poor packing materials (ceramics or composite type materials).

The nature of the powder material 15 may vary herein. In this example, the powder material 15 may be a nanostructured ferritic alloy powder and the like. Specifically, any low packing density powder (mechanically alloyed or not) or expensive powder with normal packing density. Such a material may offer superior creep and cyclic fatigue resistance for an overall longer component life. Because of the mechanically alloying process to incorporate nanoscale oxides into the steel powder, the costs of such a material may be significantly more than typical gas atomized powders. The powders used herein may have a loading/packing density of about 40 to about 70 percent. The density may increase to about 97 to about 100 percent after the hot isostatic pressing process. The resulting billet 35 may be tube like in shape and serve as, for example, a dissimilar metal weld in high temperature applications such as a heat recovery steam generator and/or other types of turbine equipment. Many other applications may be provided herein.

Further aspects of this invention are provided by the subject matter of the following clauses: a container for use in manufacturing a metal billet from a metal powder in a hot isostatic pressing process, comprising: a top; a bottom; a wall extending between the top and the bottom; the wall comprising an enhanced directional consolidation feature; and a sleeve positioned about the enhanced directional consolidation feature.

The container of any preceding clause, wherein the enhanced directional consolidation feature comprises a bellows.

The container of any preceding clause, wherein the bellows comprises a plurality of crest portions and a plurality of root portions separated by flank portions.

The container of any preceding clause, wherein the sleeve comprises one or more sleeves positioned about the bellows.

The container of any preceding clause, wherein the one or more sleeves comprise one or more internal sleeves.

The container of any preceding clause, wherein the one or more internal sleeves comprises an upper internal sleeve and a lower internal sleeve.

The container of any preceding clause, wherein the upper internal sleeve and the lower internal sleeve overlap.

The container of any preceding clause, wherein the bellows is disposed between an upper wall portion and a lower wall portion of the wall.

The container of any preceding clause, wherein the bellows is attached to the wall at a middle wall portion of the lower wall portion.

The container of any preceding clause, wherein the sleeve comprises an internal sleeve positioned about the bellows.

The container of any preceding clause, wherein the internal sleeve overlaps the lower wall portion.

The container of any preceding clause, wherein the one or more sleeves comprise one or more external sleeves.

The container of any preceding clause, wherein the one or more external sleeves comprise an upper external sleeve and a lower external sleeve.

The container of any preceding clause, wherein the upper external sleeve and the lower external sleeve overlap.

A method of manufacturing a metal billet from a metal powder in a hot isostatic pressing process, comprising: providing an enhanced directional consolidation feature in a wall of a container; filling the container with the metal powder; subjecting the container to the hot isostatic pressing process to form the metal billet; deforming the container along the enhanced directional consolidation feature; and removing the metal billet from the container.

A container for use in manufacturing a metal billet from a metal powder in a hot isostatic pressing process, comprising: a top; a bottom; a wall extending between the top and the bottom; the wall comprising a bellows; and one or more sleeves positioned about the bellows.

The container of any preceding clause, wherein the bellows is disposed between an upper wall portion and a lower wall portion of the wall.

The container of any preceding clause, wherein the one or more sleeves comprise one or more internal sleeves.

The container of any preceding clause, wherein the one or more sleeves comprise one or more external sleeves.

The container of any preceding clause, wherein the one or more sleeves overlap.

It should be apparent that the foregoing relates only to certain embodiments of this application and resultant patent. Numerous changes and modifications may be made herein by one of ordinary skill in the art without departing from the general spirit and scope of the invention as defined by the following claims and the equivalents thereof.

We claim:

1. A container for use in manufacturing a metal billet from a metal powder in a hot isostatic pressing process, comprising:

a top;

a bottom;

a wall extending between the top and the bottom;

the wall comprising an enhanced directional consolidation feature; and a sleeve positioned about the enhanced directional consolidation feature;

wherein the wall and the sleeve are positioned about the metal powder for deformation and shrinkage therewith.

2. The container of claim 1, wherein the enhanced directional consolidation feature comprises a bellows.

3. The container of claim 2, wherein the bellows comprises a plurality of crest portions and a plurality of root portions separated by flank portions.

4. The container of claim 2, wherein the sleeve comprises one or more sleeves positioned about the bellows.

5. The container of claim 4, wherein the one or more sleeves comprise one or more internal sleeves.

6. The container of claim 5, wherein the one or more internal sleeves comprises an upper internal sleeve and a lower internal sleeve.

7. The container of claim 6, wherein the upper internal sleeve and the lower internal sleeve overlap.

8. The container of claim 2, wherein the bellows is disposed between an upper wall portion and a lower wall portion of the wall.

9. The container of claim 8, wherein the bellows is attached to the wall at a middle wall portion of the lower wall portion.

10. The container of claim 8, wherein the sleeve comprises an internal sleeve positioned about the bellows.

11. The container of claim 10, wherein the internal sleeve overlaps the lower wall portion.

12. The container of claim 4, wherein the one or more sleeves comprise one or more external sleeves.

13. The container of claim 12, wherein the one or more external sleeves comprise an upper external sleeve and a lower external sleeve.

14. The container of claim 13, wherein the upper external sleeve and the lower external sleeve overlap.

15. A container for use in manufacturing a metal billet from a metal powder in a hot isostatic pressing process, comprising:

a top;

a bottom;

a wall extending between the top and the bottom;

the wall comprising a bellows; and one or more sleeves positioned about the bellows;

wherein the wall, the bellows, and the one or more sleeves are positioned about the metal powder for deformation and shrinkage therewith.

16. The container of claim 15, wherein the bellows is disposed between an upper wall portion and a lower wall portion of the wall.

17. The container of claim 15, wherein the one or more sleeves comprise one or more internal sleeves.

18. The container of claim 15, wherein the one or more sleeves comprise one or more external sleeves.

19. The container of claim 15, further comprising two sleeves and wherein the two sleeves overlap.

* * * * *